United States Patent [19]

Morishita et al.

[11] Patent Number: 4,989,467

[45] Date of Patent: Feb. 5, 1991

[54] COAXIAL TYPE STARTER DEVICE

[75] Inventors: Akira Morishita; Kazuhiro Odahara; Shuzoo Isozumi, all of Himeji, Japan

[73] Assignee: Mitsubishi Denki Kabushiki Kaisha, Tokyo, Japan

[21] Appl. No.: 425,526

[22] Filed: Oct. 24, 1989

[30] Foreign Application Priority Data

Nov. 26, 1988 [JP] Japan ..... 63-154019

[51] Int. Cl.[5] ..... F02N 11/00

[52] U.S. Cl. ..... 74/6; 74/7 R; 74/7 C; 74/7 E; 123/179 M; 290/38 C

[58] Field of Search ..... 74/6, 7 R, 7 C, 7 E; 123/179 M; 290/38 R, 38 C, 48

[56] References Cited

U.S. PATENT DOCUMENTS

| | | | |
|---|---|---|---|
| 4,760,274 | 7/1988 | Isozumi | 290/48 |
| 4,800,766 | 1/1989 | Isozumi et al. | 74/7 E |
| 4,808,836 | 2/1989 | Isozumi et al. | 74/6 |
| 4,912,992 | 4/1990 | Kinoshita | 74/7 C |
| 4,918,324 | 4/1990 | Isozumi | 290/48 |
| 4,924,108 | 5/1990 | Isozumi | 74/7 E |
| 4,926,706 | 5/1990 | Isozumi | 74/7 A |

FOREIGN PATENT DOCUMENTS

| | | |
|---|---|---|
| 3042436 | 6/1982 | Fed. Rep. of Germany . |
| 1311876 | 11/1962 | France . |

OTHER PUBLICATIONS

Patent Abstracts of Japan, vol. 12, No. 485, 1988 & JA-A-63 205459, 8/1988.

Patent Abstracts of Japan, vol. 10, No. 281, 1986 & JP-A-101670, 5/1986.

*Primary Examiner*—Leslie A. Braun
*Assistant Examiner*—Scott Anchell
*Attorney, Agent, or Firm*—Sughrue, Mion, Zinn, Macpeak and Seas

[57] ABSTRACT

A coaxial type starter device comprises a motor having a dubular armature rotary shaft 22*a*, a rotary output shaft 3 partially inserted in the tubular armature shaft from its one side, the rotary output shaft being provided with a pinion 4 to be engaged with a ring gear of an engine, a driving force transmitting unit, disposed at one side of the motor and between the armature rotary shaft and the rotary output shaft, comprising a roller type overrunning clutch 30 and a planet gear wheel type speed reducing mechanism 10 for reducing a revolutional speed of the armature rotary shaft, and an electromagnetic switch, disposed at the other side of the motor, which causes the pinion of the rotary output shaft to engage with or disengage from the ring gear of the engine. The number of rollers 30*b* in the overrunning clutch is the same as or an integral multiple of the number of the planet gear wheels 10*b* in the planet gear wheel type speed reducing mechanism; a plurality of through holes 39 corresponding in number to pins 31 for supporting the planet gear wheels are formed in the clutch outer member in the overrunning clutch to be fitted with the pins, and the clutch outer member is supported at an end portion of the armature rotary shaft through a bearing.

3 Claims, 3 Drawing Sheets

COAXIAL TYPE STARTER DEVICE

BACKGROUND OF THE INVENTION

The present invention relates to an improvement in a coaxial type starter device comprising a motor section constituted by a d.c. motor, an electromagnetic switch and a driving force transmitting unit comprising a speed reducing mechanism and an overrunning clutch, which are arranged in the same axial line.

It has been known to use a starter in which a battery is used for a source of power as a device for rotating an engine by an external force when the engine is to be started. As a type of this kind of starter, it has been known to use a coaxial type starter device wherein a motor section constituted by a d.c. motor is arranged in the same axial line as an electromagnetic switch for urging the rotary output shaft of the starter in its axial direction to thereby connect a pinion provided at an end of the rotary output shaft with a ring gear of the engine or to disconnect the pinion from the ring gear, and a driving force transmitting unit comprising a planet gear wheel type speed reducing mechanism. Further, an overrunning clutch is disposed in front of the motor section.

FIG. 4 shows a conventional coaxial type starter device of the above-mentioned type. The coaxial type starter device comprises a yoke 1 defining the outer wall of the starter and adapted to form a magnetic circuit. An armature 2 for producing a revolutional force is disposed in the yoke 1. The yoke 1 and the armature 2 constitute elements in the motor section of the starter. An armature rotary shaft 2*a* as the core of the armature 2 is in a tubular form, and a sun gear 10*a* which is an element of the planet gear wheel type speed reducing mechanism 10 is formed at an end portion (at the front side) of the outer circumference of the armature rotary shaft 2*a*. A rotary output shaft is inserted rotatably in the tubular armature rotary shaft 2*a* from its front side. A pinion 4 to be engaged with a ring gear (not shown) of the engine is fixed to the front end portion of the rotary output shaft 3 and a helical spline 5 is formed at the outer circumference of the rotary output shaft 3 at a position between the pinion 4 and the sun gear 10*a* at the front end of the armature rotary shaft 2*a* in which the rotary output shaft is partially inserted.

An electromagnetic switch 6 for urging the rotary output shaft 3, by an attracting force due to an electromagnetic force, in the direction that the pinion 4 is brought to engagement with the ring gear, is provided at the rear of the armature rotary shaft 2*a*. The front part of the rotary output shaft 3 is supported by a gear case 8 by means of a roller bearing 7 and the rear part of it receives a support in the tubular armature rotary shaft 2*a* by means of a slide bearing 9. There are provided in the gear case 8 the above-mentioned planet gear wheel type speed reducing mechanism 10 and the overrunning clutch 11 to constitute the driving force transmitting unit. The overrunning clutch 11 is constituted by a clutch outer member 11*a*, rollers 11*b* disposed inside thereof and a clutch inner member 11*c*. The clutch inner member 11*c* has a helical spline portion at its inner circumference which is adapted to mesh with the above-mentioned spline 5 formed at the outer circumference of the rotary output shaft 3. Further, the clutch outer member 11*a* is provided with holes in which pins 12 for supporting planet gear wheels 10*b* as a structural element of the planet gear wheel type speed reducing mechanism 10 are forcibly inserted.

An internal gear 10*c* meshing with the planet gear wheels 10*b* is formed in the gear case 8. The sun gear wheel 10*a*, the planet gear wheels 10*b* and the internal gear 10*c* constitute the above-mentioned speed reducing mechanism 10.

In the conventional coaxial type starter device having the above-mentioned construction, when a starter switch (not shown) is operated to start the engine, an electric current is supplied from a battery (not shown) to the electromagnetic switch 6; the plunger (not shown) in the electromagnetic switch 6 is attracted so that the rotary output shaft 3 is fowardly pushed, whereby the pinion 4 is brought to mesh with the ring gear (not shown) of the engine. On the other hand, upon attracting the plunger, contacts installed in the electromagnetic switch 6 are made and an electric current is supplied from a battery to the armature 2 so that a force of revolution is produced. The force of revolution is transmitted to the rotary output shaft 3 via the planet gear wheel type speed reducing mechanism 10 and the overrunning clutch 11, and it is further transmitted to the ring gear of the engine through the pinion 4 attached to the rotary output shaft 3, whereby the engine is started.

In the conventional coaxial type starter device having the construction described above, the positions of the holes 13 formed in the clutch outer member 11*a*, in which the pins for supporting the planet gear wheels are forcibly inserted, are determined without consideration of their positions with respect to wedge-like spaces formed in the clutch outer member 11*a*. Accordingly, the holes 13 cannot be formed as through holes extending in the axial direction of the clutch outer member. Accordingly, it was difficult to obtain accurate holes by machining operations. In the case of forming the holes 13 by a cold forging method, it was difficult to form the holes together with the wedge-like spaces by a single stamping operation. Accordingly, when the holes 13 are formed separate from the wedge-like spaces, it was inavoidable that the deviation of the holes 13 with respect to the wedge-like spaces took place.

The conventional coaxial type starter device is not of such structure that strict attention is paid to coaxial arrangement between the clutch outer member 11*a* of the overrunning clutch 11 and the armature rotary shaft 2*a*. Accordingly it was inavoidable that there occured deviation between the armature rotary shaft 2*a* and the wedge-like spaces of the overrunning clutch 11 or the pins 12 for supporting the planet gear wheels 10*b*. This caused generation of abnormal noises and a reduction in the service life.

SUMMARY OF THE INVENTION

It is an object of the present invention to provide a coaxial type starter device capable of assuring precise holes to be formed in a clutch outer member and assuring coaxial arrangement between the clutch outer member and the armature rotary shaft to thereby suppress generation of abnormal noises and prolong the service life of a speed reducing mechanism.

According to the present invention, there is provided a coaxial type starter device comprising a motor having an armature rotary shaft in a tubular form, a rotary output shaft partially inserted in the tubular armature shaft from its one side, the rotary output shaft being provided with a pinion to be engaged with a ring gear of an engine, a driving force transmitting unit, disposed at one side of the motor and between the armature rotary shaft and the rotary output shaft, comprising a roller type overrunning clutch and a planet gear wheel type speed reducing mechanism for reducing a revolutional speed of the armature rotary shaft, and an electromagnetic switch, disposed at the other side of the motor, which causes the pinion of the rotary output shaft to engage with or to disengage from the ring gear of the engine, characterized in that the number of rollers in the overrunning clutch is the same as or an integral multiple of the number of the planet gear wheels in the planet gear wheel type speed reducing mechanism; a plurality of through holes corresponding in number to pins for supporting the planet gear wheels are formed in the clutch outer member in the overrunning clutch to be fitted with the pins, and the clutch outer member is supported at an end portion of the armature rotary shaft through a bearing.

IN THE DRAWINGS

DETAILED DESCRIPTION OF THE PREFERRED EMBODIMENT

Preferred embodiment of the coaxial type starter device of the present invention will be described with reference to the drawings.

Figure 1:
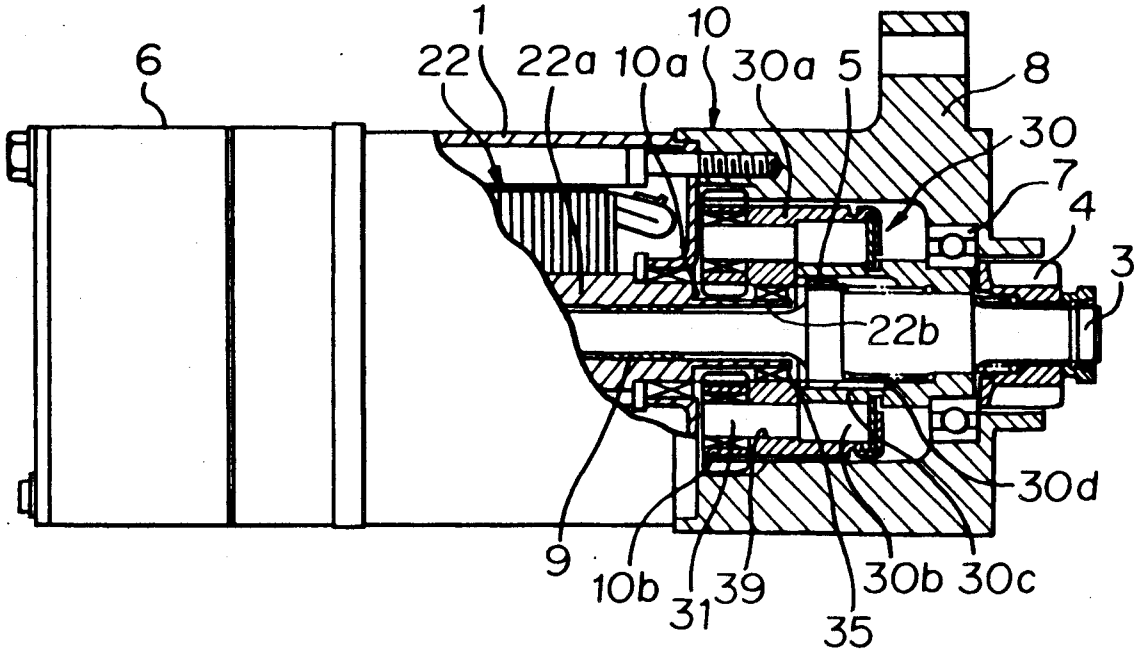
FIG. 1 is a cross-sectional view of an embodiment of the coaxial type starter device according to the present invention.
Figure 4:
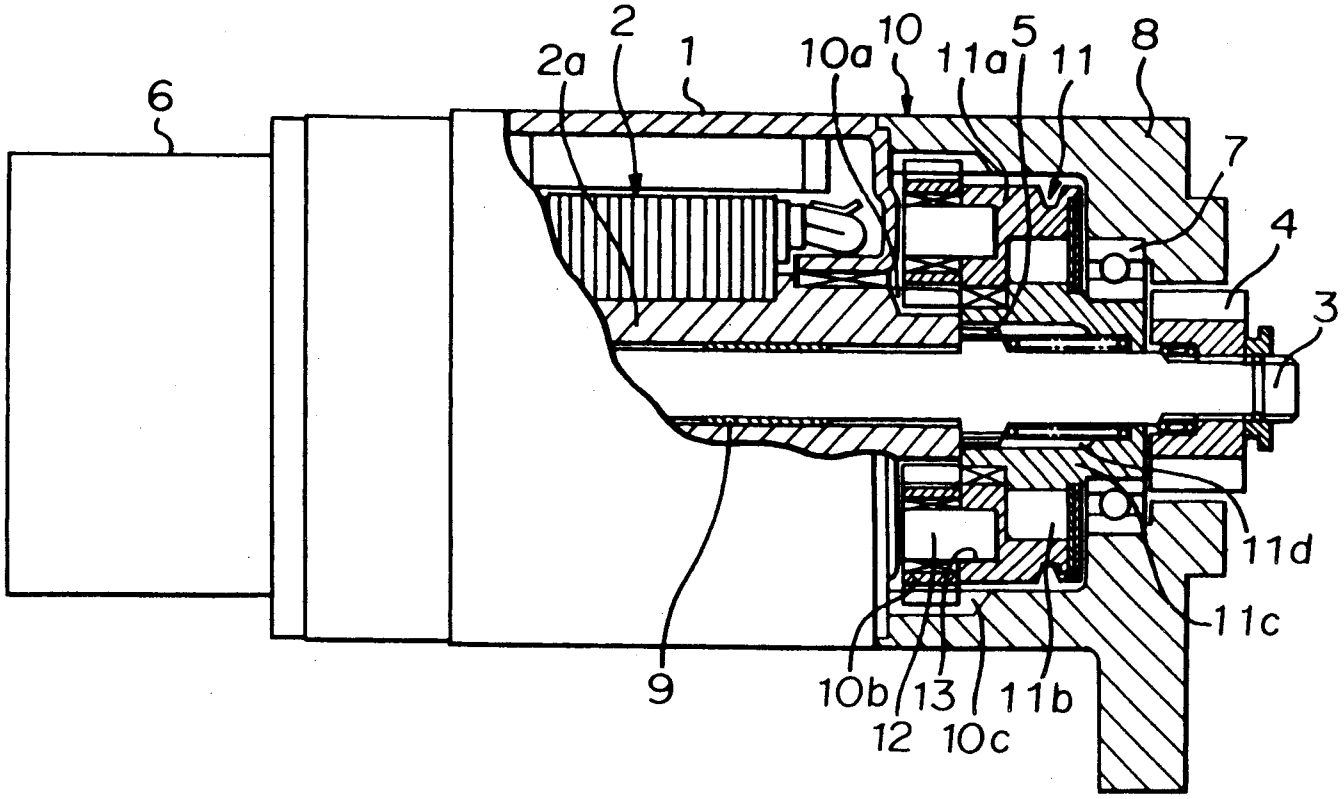
FIGURE 4 PRIOR ART
FIG. 4 is a cross-sectional view partly omitted of a conventional coaxial type starter device.

In FIG. 1 showing a preferred embodiment of the coaxial type starter device of the present invention, the same reference numerals as in FIG. 4 designate the same or corresponding parts and therefore description of these parts is omitted.

A motor section of the coaxial type starter device is constituted by a yoke 1 and an armature 22 placed inside the yoke 1 to generate a force of revolution. An armature rotary shaft 22*a* is in a tubular form and a sun gear 10*a* which is an element of a planet gear wheel type speed reducing mechanism 10 is formed at a part of an annular extention having a reduced diameter which is formed integrally with and extending from an end of the armature rotary shaft. The annular extention having a reduced diameter constitutes a step portion 22*b* in a cross-sectional view of the armature rotary shaft 22*a*. The step portion 22*b* extends inside a clutch outer member 30*a* of an overrunning clutch 30. The clutch outer member 30*a* is supported by the step portion 22*b* formed at the end portion of the armature rotary shaft 22*a* through a bearing 35. A rotary output shaft 3 is inserted rotatably in the tubular armature rotary shaft 22*a*from its front part. At the rear side of the armature rotary shaft 22*a*, an electromagnetic switch 6 is placed. In front of the motor section, there is a gear case 8 in which the above-mentioned planet gear wheel type speed reducing mechanism 10 and the overrunning clutch 30 are disposed to thereby constitute a driving force transmitting device. The overrunning clutch 30 is consitituted by the clutch outer member 30*a*, rollers 30*b* arranged inside the clutch outer member 30*a* and a clutch inner member 30*c* which includes a helical spline 30*d* to be meshed with a spline 5 formed at the outer circumference of the rotary output shaft 3. A plurality of through holes 39 in which pins 31 for supporting the planet gear wheels 10*b* of the planet gear wheel type speed reducing mechanism 10 are forcibly inserted, are formed in the clutch outer member 30*a*.

Figure 2:
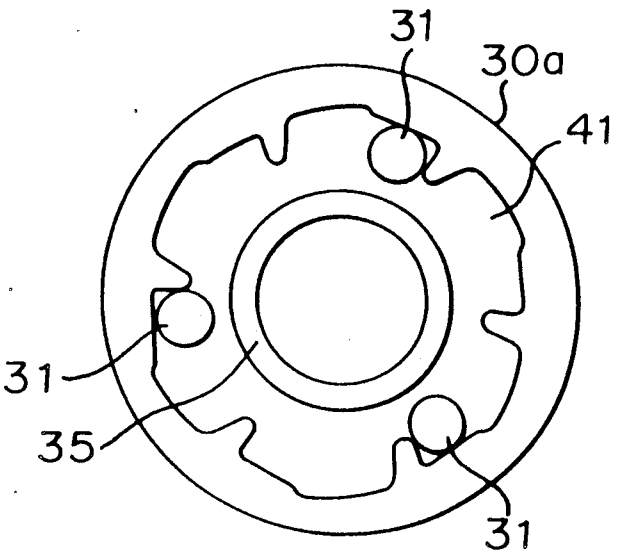
FIG. 2 is a front view of a clutch outer member used for the coaxial type starter device as shown in FIG. 1.
Figure 3:
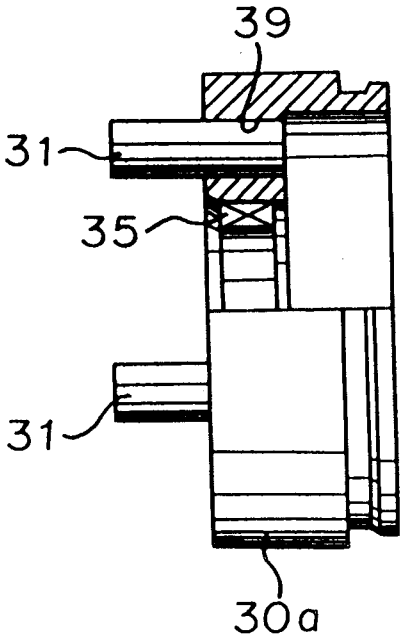
FIG. 3 is a cross-sectional view of the clutch outer member as shown in FIG. 2.

FIG. 2 is a front view of the clutch outer member 30*a* and FIG. 3 is a cross-sectional view of the clutch outer member 30*a*. Six wedge-like spaces 41 are formed in the clutch outer member 30*a*. A roller 30*b* is placed in each of the wedge-like spaces 41. The rollers 30*b* are pushed by compression springs (not shown) so that a force of revolution from the speed reducing mechanism 10 is transmitted to the clutch inner member 30*c* by performing an action of key, or they function so as not to transmit the force of revolution of the rotary output shaft 3 to the clutch outer member 30*a* by performing idling operation. The through holes 39 for receiving the pins 31 are formed alternately in the six wedge-like spaces 41, namely, three through holes are formed in three wedge-like spaces 41. These through holes 39 are located in the wedge-like spaces at positions where they do not interfere with the revolving operations of the rollers 30*b* and the operation of the compression springs.

The operation of the coaxial type starter device of the above-mentioned embodiment will be described. On operating a starter switch, an electric current flows from a battery to the electromagnetic switch 6 so that the rotary output shaft 3 is urged fowardly and the pinion 4 is meshed with a ring gear of an engine. On the other hand, when a plunger of the electromagnetic switch is attracted, contacts installed in the switch 6 are made and a current flows to the armature 22 to thereby produce a torque. The torque is transmitted to the clutch outer member 30*a* of the overrunning clutch 30 through the planet gear wheel type speed reducing mechanism. The torque is further transmitted to the rotary output shaft 3 via the rollers 30*b*, the clutch inner member 30*c* and the helical splines 30*d*, 5, whereby the ring gear (not shown) of the engine is rotated by the pinion 4; thus, the engine is started.

In the above-mentioned embodiment, description has been made as to the case that the number of the wedge-like spaces 41, i.e. the number of the rollers 30*b* is six and the number of the pins 31 for supporting the planet gear wheels 10*b* is three. However, the number of the rollers 30*b* may be the same as or an integral multiple of the number of pins 31. The same effect can be obtained so long as the numbers of the rollers 30*b* and the pins 31 have the above-mentioned relation.

In the above-mentioned embodiment, the through holes 39 in which the pins 31 for supporting the planet gear wheels 10*b* are inserted are formed in the wedge-like spaces at areas of non-rolling operations of the rollers 30*b*. However, the position of the through holes 39 may be any location in the wedge-like spaces 41 so long as they do not adversely influence the rolling operation of the rollers 30*b*.

Thus, in accordance with the present invention, accuracy in forming the through holes for receiving the pins for supporting the planet gear wheels can be increased. Further, eccentricity of the clutch outer member with respect to the armature rotary shaft can be eliminated to thereby minimize generation of abnormal noises and the service life of the starter device can be prolong.

We claim:

1. A coaxial type starter device, comprising: a motor having a tubular armature rotary shaft, a rotary output shaft partially inserted in one end of the tubular armature shaft, the rotary output shaft having a pinion adapted to be engaged with a ring gear of an engine, a driving force transmitting unit disposed at one axial end of the motor for operatively coupling the armature rotary shaft and the rotary output shaft, said unit comprising a roller type overrunning clutch and a planet gear wheel type speed reducing mechanism for reducing a revolutional speed of the armature rotary shaft, and an electromagnetic switch disposed at the other axial end of the motor for causing the pinion of the rotary output shaft to engage with or to disengage from the ring gear of the engine, wherein the number of rollers (30*b*) in the overrunning clutch is the same as or an integral multiple of the number of planet gear wheels (10*b*) in the planet gear wheel type speed reducing mechanism; a plurality of through holes (39) corresponding in number to pins (31) for supporting the planet gear wheels being formed in an outer member of the overrunning clutch to be fitted with the pins, and the clutch outer member being supported at an end portion of the armature rotary shaft by a bearing (35).

2. The coaxial type starter device according to claim 1, wherein said bearing is disposed on an annular extension having a reduced diameter which is formed integrally with and extending from an end of the armature rotary shaft facing said planet gear wheel type speed reducing mechanism.

3. The coaxial type starter device according to claim 1, wherein a plurality of wedge-like spaces are formed in said clutch outer member for individually accommodating said rollers.

* * * * *